United States Patent [19]

Shibazaki et al.

[11] 4,265,440

[45] May 5, 1981

[54] COMPUTER-CONTROLLED PAPER FEEDER

[75] Inventors: Kenji Shibazaki, Nukata; Kenichi Arai, Nakano; Tsuneo Kitagawa, Toyohashi; Tomoji Murata, Toyokawa; Kenzo Nagata, Okazaki, all of Japan

[73] Assignee: Minolta Camera Kabushiki Kaisha, Osaka, Japan

[21] Appl. No.: 19,893

[22] Filed: Mar. 12, 1979

[30] Foreign Application Priority Data

Mar. 25, 1978 [JP] Japan ..... 53/34424

[51] Int. Cl.[3] ..... B65H 1/26; B65H 3/44

[52] U.S. Cl. ..... 271/9; 271/259

[58] Field of Search ..... 271/9, 259, 258, 256, 271/157, 158, 159, 118, 127; 355/3 SH, 14 SH; 414/41; 226/110

[56] References Cited

U.S. PATENT DOCUMENTS 3,977,666 8/1976 Suzuki et al. ..... 271/9

FOREIGN PATENT DOCUMENTS 52-25639 2/1977 Japan ..... 271/9

*Primary Examiner*—Bruce H. Stoner, Jr.

*Attorney, Agent, or Firm*—Wenderoth, Lind & Ponack

[57] ABSTRACT

A computer-controlled paper feeder comprises at least first and second supply units from which respective recording materials are supplied one at a time towards a processing station. There is provided a size detector for detecting the size of the recording material contained in respective cassettes inserted in the associated first and second supply units and an emptiness detector for detecting the presence and absence of the recording material in any one of the cassettes in the first and second supply units. These detectors are so correlated with micro-computer that, when the recording material in one of the cassettes has been consumed and the size of the recording material in the other of the cassettes has been found equal to that in the one of the cassettes, the corresponding supply unit is brought into operation to feed the recording material out of the other of the cassettes towards the processing station until the recording material in the other of the cassettes is completely consumed.

4 Claims, 6 Drawing Figures

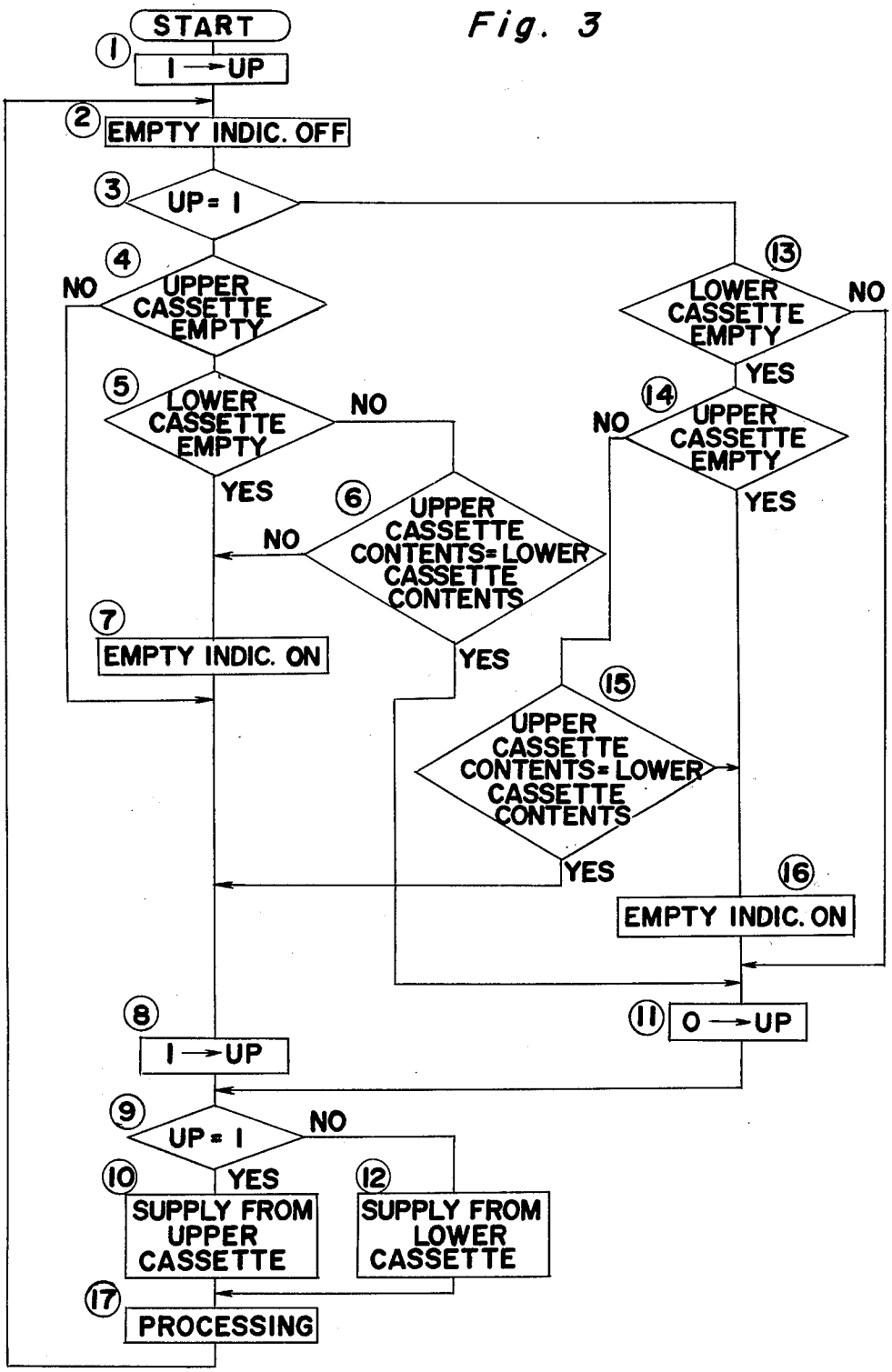
Fig. 3
START
1
I → UP
2
EMPTY INDIC. OFF
3
UP = I
4
UPPER CASSETTE EMPTY
NO
5
LOWER CASSETTE EMPTY
NO
YES
6
UPPER CASSETTE CONTENTS = LOWER CASSETTE CONTENTS
NO
YES
7
EMPTY INDIC. ON
8
I → UP
9
UP = I
NO
YES
10
SUPPLY FROM UPPER CASSETTE
12
SUPPLY FROM LOWER CASSETTE
17
PROCESSING
13
LOWER CASSETTE EMPTY
NO
YES
14
UPPER CASSETTE EMPTY
NO
YES
15
UPPER CASSETTE CONTENTS = LOWER CASSETTE CONTENTS
YES
16
EMPTY INDIC. ON
11
0 → UP

COMPUTER-CONTROLLED PAPER FEEDER

BACKGROUND OF THE INVENTION

The present invention generally relates to a paper feeder for use in a copying machine or a printing machine and, more particularly, to a paper feeder of a type comprising at least two supply units for the support or storage of recording materials such as papers, which supply units are alternately brought into operation one at a time when the recording material contained in one of the supply units has been used and if the recording materials respectively contained in the supply units are of the same size.

To those who are concerned with the manufacture of electrophotographic copying machines or printing machines, there is well known a paper feeder of a type comprising at least two supply units for the support or storage of recording materials each being in the form of a batch of papers of equal size, which supply units are selectively brought into operation one at a time. In this known paper feeder, the supply units are so designed as to accommodate respective recording materials of different size, and it is considered convenient in that, when copying or printing is desired to be effected on the recording material of a size different from that previously used, an appropriate supply unit can be brought into operation to cope with the desire. This is in contrast to the paper feeder comprising a single supply unit which requires occassional replacement of the recording material of one particular size with that of a different size.

However, so far as the capability of successive feeding of papers of one particular size is involved, there is no difference in performance between the paper feeder of the type having at least two supply units and that having only one supply unit. This is because one supply unit operates independently of the other supply unit and the two are not operatively associated with each other. This equally applies even in the case where at least one of the supply units is so adjustably designed as to accommodate the recording material of a size equal to that accommodated in the other of the supply units. Therefore, when two batches of papers of equal sizes are placed in the respective supply units to enable the paper feeder to supply a relatively large number of papers in excess of the number of the papers of one batch accommodated in one supply unit, a manual intervention is required when one batch of papers in one of the supply units have completely been consumed, so that the other of the supply units can be brought into operation.

In particular, when an electrophotographic copying machine having the paper feeder of the above described type incorporated therein is used, it has often been experienced that, in view of the fact that the number of papers of two batches of equal or different sizes remaining in the respective supply units is not known to an operator of the copying machine, the paper feeder will supply no paper from one of the supply units when the papers contained in such one of the supply units have completely been consumed and, in such case, the operator is required to manipulate a switching mechanism to bring the other of the supply units into operation if such other of the supply units has contained a batch of papers equal in size to that of the consumed papers or to replenish the empty supply unit with a fresh batch of papers of a size equal to that of the consumed papers.

However, the Japanese Patent Laid-open Publication No. 52-25639, laid open to public inspection on Feb. 25, 1977, discloses a similar paper feeder for use in a copying machine which substantially obviates the above described disadvantages and inconveniences. This prior art paper feeder disclosed in the above mentioned publication comprises at least first and second trays positioned one above the other for the support of respective first and second containers, containing therein respective batches of copying papers, which may be either equal or different in size; first and second feed rolls operatively associated with the respective first and second trays, any one of the first and second feed rolls being, when the container on the corresponding tray is filled with the copying papers, brought into contact with the top of the copying papers for feeding the latter from the corresponding container on the corresponding tray towards a processing station during rotation thereof; a first drive control including a first electromagnetic clutch which is, when the first drive control is activated, engaged to allow the first feed roll to be driven in one direction; a second drive control including a second electromagnetic clutch which is, when the second drive control is activated, engaged to allow the second feed roll to be driven in one direction; a size selector switch having a movable contact electrically connected to a power source and first and second fixed contacts respectively electrically connected to the first and second drive controls; a size detector positioned between the power source and any one of the first and second drive controls for detecting whether or not the size of the container placed on the first tray is equal to that placed on the second tray and operable to allow the passage of an electric power from the power source therethrough only when the containers on the respective first and second trays and, therefore, the copying papers in the associated containers, are equal in size to each other; means operable by the electric power fed through the size detector to interrupt the supply of the electric power from the power source to any one of the first and second drive controls through the size selector switch; a first paper detector means, including a first relay switch disposed on an electric circuit between the first drive control and the size detector, for detecting whether or not the container on the first tray is filled with the copying papers and for causing the first relay switch to close only during the presence of the copying papers in the container on the first tray whereby, so long as the interrupting means is held in position to interrupt the supply of the electric power from the power source to any one of the first and second drive controls through the size selector switch due to the presence of the copying papers of the two batches of equal size in the containers respectively placed on the first and second trays, the first drive control can be activated by the electric power fed through the size detector; and a second paper detector means including a second relay switch and operable only when and so long as the first paper detector means is brought in an inoperative position due to complete consumption of the copying papers from the container on the first tray, for detecting whether or not the container on the second tray is filled with the copying papers and for causing the second relay switch to close only during the presence of the copying papers in the container on the second tray and the absence of the copying papers in the container on the first tray whereby, so long as the interrupting means is held in position to interrupt the supply of the electric power from the power source to any one of the first and second drive controls through the size selector switch due to the presence of the copying papers of the two batches of equal size in the containers respectively placed on the first and second trays, the second drive control can be activated by the electric power fed through the size detector.

The prior art paper feeder disclosed in the above mentioned publication further comprises a first indicator lamp energizable during the engagement of the first drive control to show that the first tray is in an operative position with the papers in the container on the first tray being fed by the first feed roll towards the processing station, and a second indicator lamp energizable during the engagement of the second drive control to show that the second tray is in an operative position with the papers in the container on the second tray being fed by the second feed roll towards the processing station.

In summary, the prior art paper feeder of the construction described above is so designed that, when and so long as the identical containers containing the respective batches of copying papers of equal size are placed on the associated first and second trays, the first drive control is activated to cause the first electromagnetic clutch to be engaged to drive the first feed roll and the second drive control is subsequently activated to cause the second electromagnetic clutch to be engaged to drive the second feed roll while the first drive control is inactivated when and after the copying papers in the container on the first tray have been consumed. Yet, after the copying papers in the container on the first tray have completely been consumed and it has subsequently been replenished with a fresh batch of copying papers of equal size during the copying papers being fed out of the container on the second tray, the second drive control is immediately inactivated while the first drive control is activated before the copying papers in the container on the second tray are completely consumed. However, after the copying papers in the container on the first tray have completely been consumed and it has subsequently been replenished with a fresh batch of copying papers of a size different from that previously consumed, the size detector is held in position to interrupt the supply of the electric power therethrough to any one of the first and second drive controls, but completing the circuit between the power source and the movable contact of the manipulatable size selector switch and, depending upon the position of the movable contact of the size selector switch, there is the possibility that, in the course of reproduction of information on the copying papers of equal size, that information will be reproduced on one or more copying papers of a size different from that of the previously used copying papers.

SUMMARY OF THE INVENTION

Accordingly, the present invention has for its essential object to provide an improved paper feeder which substantially obviates the above described disadvantages and inconveniences inherent in the prior art paper feeder.

Another important object of the present invention is to provide an improved paper feeder of the type referred to above, which is particularly suited for use in a printing or copying machine without substantially increasing the size of such machine.

A further object of the present invention is to provide an improved paper feeder of the type referred to above, wherein there are provided at least two supply units which can selectively be brought into operation one at a time as desired.

A still further object of the present invention is to provide an improved paper feeder of the type referred to above wherein, after the copying paper, which is accommodated in one of the corresponding supply units, has completely been consumed, the other of the supply units can automatically be brought into operation, so long as the copying papers in the other of the supply units are equal in size to that previously consumed from the one of the supply units, and the operation of the other of the supply units can continue at least until the whole number of the copying papers in the other of the supply units is completely consumed.

BRIEF DESCRIPTION OF THE DRAWINGS

These and other objects and features of the present invention will become apparent from the following description taken in conjunction with a preferred embodiment thereof with reference to the accompanying drawings, in which:

FIG. 3 is a flow chart showing the sequence of operation of a paper feeder of the present invention as controlled by the micro-computer;

FIG. 4(*b*) is a perspective view, on an enlarged scale, showing a code member provided in each of the cassettes in combination with a microswitch assembly for the detection of the size of the copying papers contained in the corresponding cassette.

DETAILED DESCRIPTION OF THE INVENTION

Figure 1:
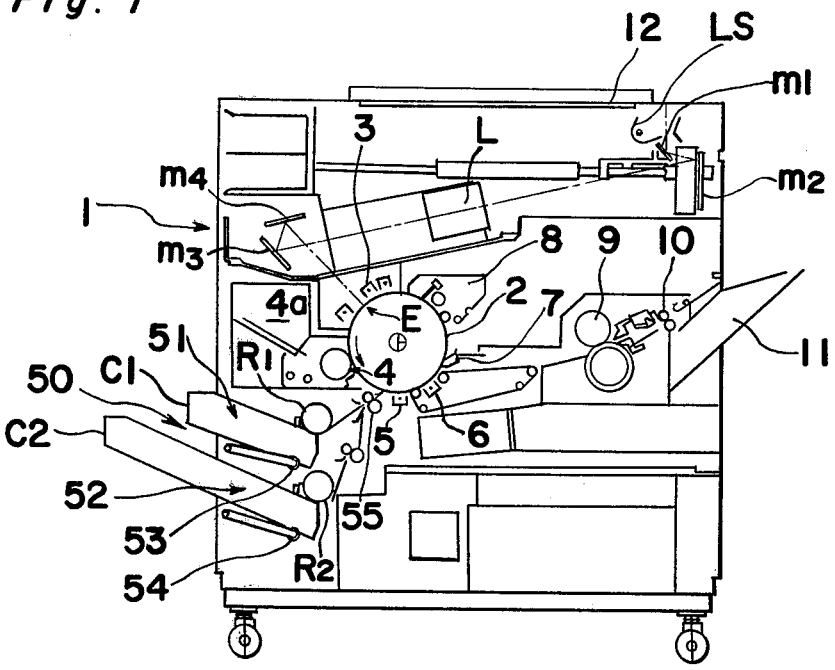
FIG. 1 is a schematic side view of an electrophotographic copying machine, showing the arrangement of various components of the copying machine.

Before the description of the present invention proceeds, it is to be noted that like parts are designated by like reference numerals throughout the accompanying drawings.

Referring first to FIG. 1 which schematically illustrates an electrophotographic copying machine to which the present invention is applied, the electrophotographic copying machine 1 comprises a photo-receptor drum 2 supported in a machine housing for rotation in one direction, for example, counterclockwise as shown by the arrow, past a plurality of operative stations involved in carrying out the electrophotographic process. These operative stations include a charging station where the photo-receptor on the drum 2 is electricaly charged by a charger 3; a projecting station E where the electrically charged photo-receptor is exposed imagewise to light to have a latent image formed thereon; a developing station 4 where toner powder is supplied from a developer tank 4*a* onto the photo-receptor to develop the latent image into a toner powder image; an image transfer station where the toner powder image on the photo-receptor is transferred onto a copying paper P while electrically charged by a charger 5; an erasing station where an erasing AC charger 6 is located for erasing a residual electric charge on the photo-receptor; a stripping station where a separator 7 is located for stripping the copying paper P from the photo-receptor; and a cleaning station where a cleaning unit 8 is located for cleaning the photo-receptor on the drum 2.

The electrophotographic copying machine is so designed that, during the continued rotation of the photo-receptor drum 2, the photo-receptor on the drum 2 is formed at the projecting station with the latent image which is subsequently developed at the developing station into the toner powder image, the toner powder image being in turn transferred at the transfer station onto the copying paper P. The copying paper bearing the toner powder image is then separated from the photo-receptor drum 2 by the separator 7, fixed by a heating roll 9 as it passes therethrough and finally fed onto a receptacle tray 11 by an ejecting roll assembly, thereby completing the copying operation.

For projecting an optical image of the original to be reproduced, which is placed on a transparent support 12, onto the photo-receptor drum 2 at the projecting station, the electrophotographic copying machine further comprises an optical system including a light source LS, supported for reciprocal movement below the transparent support 12, a first reflective mirrow m1, a second reflective mirror m2, a lens assembly L, and fixed reflective mirrors m3 and m4, all being so positioned and so arranged that the original placed on the transparent support 12 can be scanned by the movable carriage including the light source LS and the first and second reflective mirrors m1 and m2 and the image of the original is transmitted through the lens assembly L and towards the photo-receptor drum 2 after having been reflected by the fixed reflective mirrors m3 and m4. As the photo-receptor on the drum 2 being rotated is exposed to the light image so projected in the manner described, an electrostatic latent image corresponding to the image of the original is formed on the photo-receptor on the drum 2.

For supplying the copying paper P, the electrophotographic copying machine 1 comprises a paper feeder 50 which is, for the purpose of illustrating the present invention, shown as including upper and lower supply units 51 and 52. As illustrated in FIG. 1, paper cassettes C1 and C2 of different sizes, which accommodate therein respective batches of copying papers, the copying papers of one batch within the cassette C1 being, therefore, different in size from that of the other batch within the cassette C2, are placed in the upper and lower supply units 51 and 52. Each of the upper and lower supply units 51 and 52 includes a lifting roll 53 or 54 which, when the corresponding cassette C1 or C2 is completely inserted into the associated supply unit 51 or 52, upwardly lifts the batch of the copying papers so that the latter can contact a feed roll R1 or R2 operable to supply the copying papers successively one after another towards the transfer station when and so long as such roll R1 or R2 is rotated by a suitable selection signal applied thereto.

As is well known to those skilled in the art, each copying paper supplied from any one of the paper cassettes C1 and C2 in the respective supply units 51 and 52 is held at a standstill at a position proximate to a timing roll assembly 55 which is so synchronized with the rotation of the photo-receptor drum 2 as to feed the copying paper therethrough towards the transfer station simultaneously with the arrival of the toner powder image on the photo-receptor drum 2 at the transfer station.

As can be understood from FIG. 1, the length of a passage through which the copying papers from the cassette C1 travel towards the transfer station and that of a passage through which the copying papers from the cassette C2 travel towards the transfer station are obviously different from each other. Therefore, the sequence of operation of the timing roll assembly 55 assumed when the upper supply unit 51 is brought into an operative position differs from that assumed when the lower supply unit 52 is brought into an operative position. However, the electrophotographic copying machine 1 is to be understood as including a micro-computer utilized not only for controlling the operation of the various components of the machine, but also controlling the sequence of operation of the timing roll assembly 55. It is to be noted, however, in accordance with the teachings of the present invention, the same micro-computer as used for controlling the machine components is concurrently used to control the operation of the paper feeder of the present invention as will become clear from the subsequent detailed description.

Figure 2:
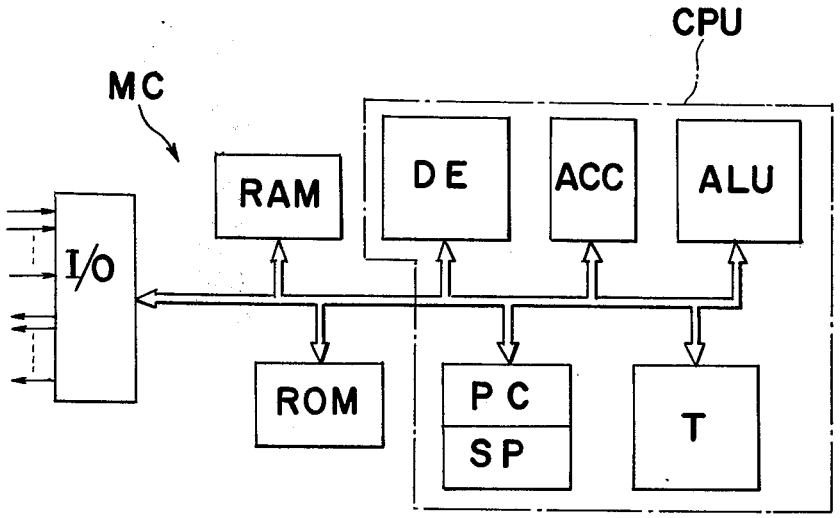
FIG. 2 is a schematic block diagram of a micro-computer employed in accordance with the present invention for controlling the operation of various components of the copying machine shown in FIG. 1.

The micro-computer will now be described with reference to FIG. 2. As shown in FIG. 2, the micro-computer MC comprises a central processing unit CPU, including an arithmetic logic unit ALU, an accummulator ACC, a decoder DE, a program counter PC, a stack pointer SP and an LSI circuit board having a random access memory RAM and a read-only memory ROM which are fabricated into one or separate chips, and is adapted to receive input signals from external electric circuits through an input-output interface I/o and to generate a control signal to external electric circuits.

The control signal is used to count the number of reference pulses generated mainly by the timer T and to generate operation control signals to be applied to the various components of the copying machine in accordance with a program stored in the read-only memory ROM according to the number of the reference pulses counted thereby, the details thereof being, however, omitted for the sake of brevity since they do not constitute a subject matter of the present invention. It is to be noted that the central processing unit CPU of the micro-computer MC is to be understood as further including, in addition to the components shown in FIG. 2, a flag flip-flop and various working registers with or without its peripheral LSI elements added.

The paper feeder embodying the present invention, which utilizes the micro-computer, will now be described with particular reference to a flow chart shown in FIG. 3, a paper empty and paper size detecting mechanism shown in FIG. 4*a* and FIG. 4*b* and a circuit diagram shown in FIG. 5.

Referring first to the flow chart of FIG. 3, the sequence of controlled operation of the paper feeder will be described. Assuming that a power supply switch is turned on to supply an electric power to the copying machine, the micro-computer is supplied with the electric power and, therefore, brought into operation to start various controls. So far as the control of the paper feeder is involved, a start signal generating section generates a start signal with which the flag flip-flop is set to a high level state "1" to bring the copying machine into an initial operative condition. This is the step 1. Subsequent to the step 1, a paper empty indication is cleared at the step 2. A symbol"UP" represents a discriminating flag and, when it is set to a high level state "1", it means that the upper supply unit 51 is selected, i.e., is brought to an operative position wherein the associated feed roll R1 is in position to feed the copying papers out of the corresponding cassette C1 in the upper supply unit 51 one at a time. It is to be noted that the selection of the upper supply unit 51 is carried out by an operator of the copying machine and a signal indicating that the operator has selected the upper supply unit is supplied through the interface I/o into the discriminating flag UP in the central processing unit CPU. Depending on the contents entered in the discriminating flag UP, the following control is performed in accordance with the program stored in the read-only memory ROM. At the step 3, the contents of the discriminating flag UP are discriminated by the accumulator ACC and, when they are in the high level state "1", the process proceeds to the step 4. At the step 4, discrimination is carried out to find whether or not the paper cassette C1 in the upper supply unit 51 is empty. The details of this empty detection will be described later.

Unless the cassette C1 in the upper supply unit 51 is empty, the step 8 takes place wherein the discriminating flag UP is again set to a high level state 37 1", and the discriminating flag UP is discriminated at the step 9 and a signal indicating that the copying paper be supplied from the upper supply unit 51 is then generated at the step 10. On the contrary thereto, if the cassette C1 in the upper supply unit 51 is empty, the step 5 takes place subsequent to the step 4 and discrimination is carried out to find whether or not the cassette C2 in the lower supply unit 52 is empty. If the cassette C2 in the lower supply unit has been found empty, then, the paper empty indication is made at the step 7.

However, if the cassette C2 in the lower supply unit 52 is not empty, the step 6 takes place subsequent to the step 5 and discrimination is made to find whether or not the copying papers accommodated in the respective cassettes C1 and C2 in the associated supply units 51 and 52 are equal in size to each other. If they are not equal in size, the step 6 is followed by the step 7 and the paper empty indication is made.

However, if the papers in the respective cassettes C1 and C2 are equal in size, the step 6 is followed by the step 11 at which the discriminating flag UP is set to a low level state "0". When the discriminating flag UP is so set to the low level state "0" in the manner described above, the process proceeds to the step 12 through the step 9 and a signal indicating that the copying paper be supplied from the cassette C2 in the lower supply unit 52 is generated. In this way, if the cassette C1 in the upper supply unit 51 is empty and the copying papers contained in the cassette C2 in the lower supply unit 52 are found equal in size to the copying papers which have previously been contained in the cassette C1 in the upper supply unit 51, the lower supply unit 51 is automatically brought into operation to allow the copying papers to be supplied one at a time towards the transfer station. The details of detection of the size of the copying papers will be described later.

It is to be noted that the sequence of operation similar to that described above takes place even when the discriminating flag UP is set to a low level state "0" at the state 2, that is, when the lower supply unit 52 is selected by the operator. In this case, the step 3 is followed by the step 13 and discrimination is made to find whether or not the cassette C2 in the lower supply unit 52 is empty. If the cassette C2 in the lower supply unit 52 is found empty, the step 13 is followed by the step 14 and discrimination is made to find whether or not the cassette C1 in the upper supply unit 51 is empty. On the contrary, if the cassette C2 in the lower supply unit 52 is not empty, the step 13 is followed by the step 11 and a process similar to that described hereinbefore subsequently takes place.

If the cassette C1 in the upper supply unit 51 is found empty at the stage 14, the paper empty indication is made while, if it is not, the step 14 is followed by the step 15 at which discrimination is made as to the size of the copying papers contained in each of the cassettes C1 and C2. If the both are equal in size, the step 15 is followed by the step 8 while, if they are not, the step 15 is followed by the step 16. Therefore, it will readily be seen that, if the cassette C2 in the lower supply unit 52 is empty and the copying papers contained in the cassette C1 in the upper supply unit 51 are found equal in size to the copying papers which have previously been contained in the cassette C2 in the lower supply unit 52, the upper supply unit 51 is automatically brought into operation to allow the copying papers to be supplied one at a time towards the transfer station from the cassette C1 in the upper supply unit 51.

Figure 4:
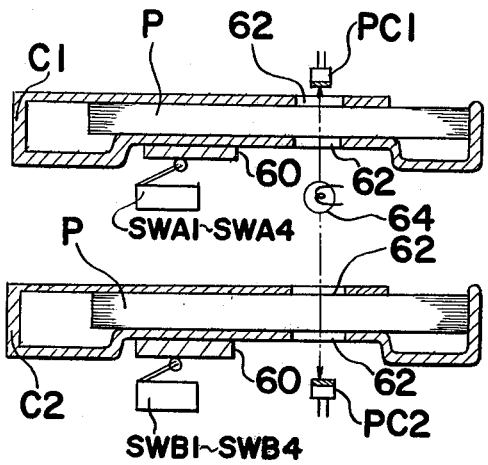
FIG. 4(*a*) is a schematic longitudinal side sectional view showing paper cassettes positioned one above the other and the manner of detecting the presence and absence of copying papers in each of the cassettes.
Figure 4:
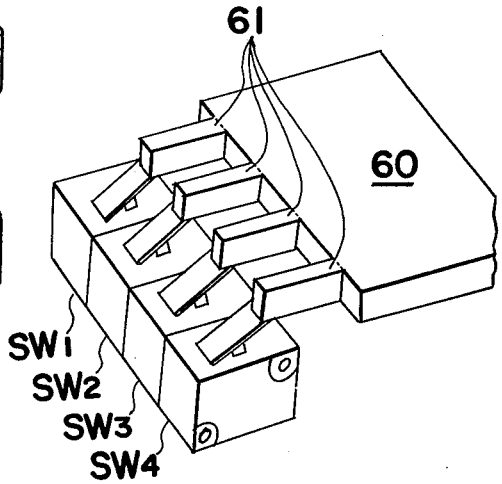

FIG. 4(*a*) illustrates the manner of mounting of the paper cassettes C1 and C2 in the copying machine 1 one above the other while FIG. 4(*b*) illustrates the details of a code member 60 in combination with microswitches SW1, SW2, SW3 and SW4 for each of the cassettes C1 and C2, code member 60 and microswitches SW1 to SW4 being utilized to detect the size of the copying papers contained in any one of the cassettes C1 and C2. As best shown in FIG. 4(*a*), the code member 60 is rigidly secured by the use of a bonding agent or fastening elements to, or otherwise integrally formed with, the bottom of each of the cassettes C1 and C2 and has a plurality of, for example, four fingers 61 which, when the corresponding cassette C1 or C2 is inserted into the copying machine 1 in a manner substantially as shown in FIG. 1, depress respective actuators of the microswitches SW1 to SW4 to turn the latter on. It is to be noted, since the number and the position of the fingers 61 of the code member 60 is indicative of the size of the copying papers contained in the cassette, the number of the microswitches SW1 to SW4 which are closed when such cassette bearing such code member 60 is inserted into the copying machine 1 depends on the number of the fingers 61.

Each of the cassettes C1 and C2 has a top cover, Such top cover and the bottom having respective apertures 62 defined therein in alignment with each other for the passage of a beam of light therethrough from a detector lamp 64 towards a corresponding detector cell PC1 or PC2 during the absence of the copying paper in the associated cassette C1 or C2.

In this arrangement, it will readily be seen that, if the number of the fingers 61 employed in the code member 60 is four as shown in FIG. 4(*b*), microswitches SW1 to SW4 are depressed with such four fingers 61 and generate the code signal (1111). Thus, the system can identify 16 types of copying papers including the code ($\phi\phi\phi\phi$). In other words, the paper feeder of the present invention can accommodate 16 types of paper cassettes containing respective batches of copying papers of different size.

As for the detection of the emptiness of any one of the paper cassettes C1 and C2 so far illustrated, it can be carried out when the beam of light emitted from the lamp 64 is received by any one of the detector cells PC1 and PC2 because, in the absence of any copying paper in one or both of the cassettes C1 and C2, it can pass therethrough by way of the apertures 62 towards one or both of the detector cells PC1 and PC2.

Figure 5:
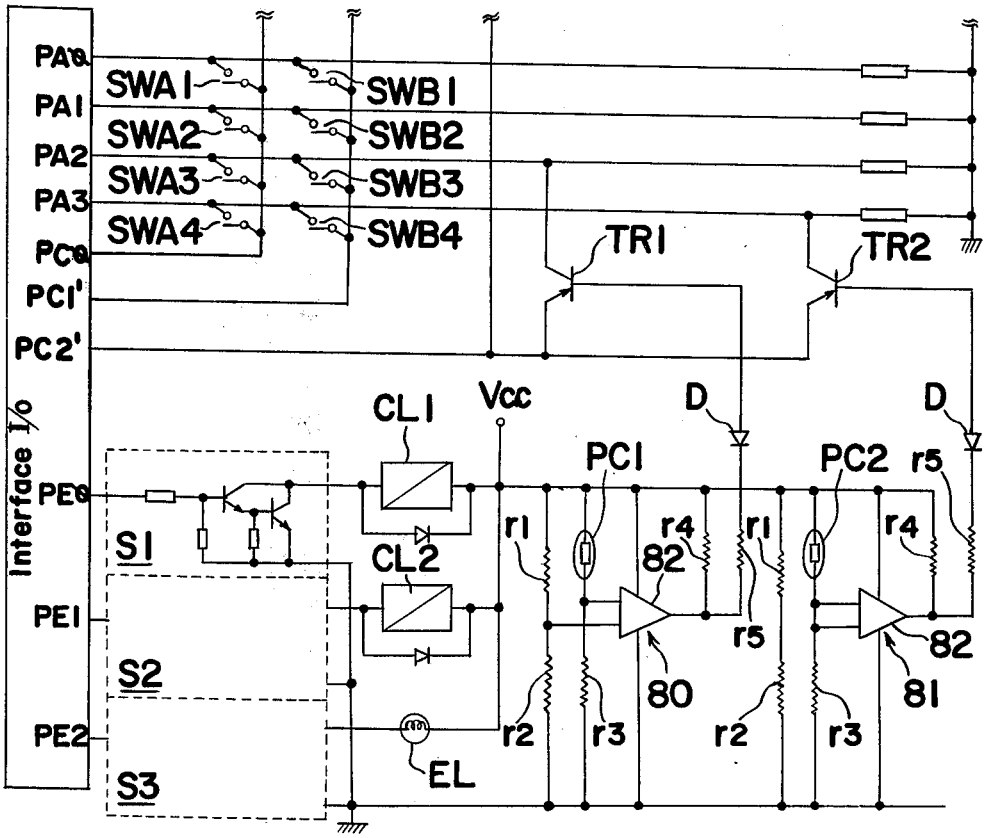
FIG. 5 is a schematic circuit diagram showing an electric circuit used in the paper feeder and its connection with the micro-computer.

Referring to FIG. 5, the input/output interface I/o of the micro-computer MC is shown as having input ports PAϕ, PA1, PA2 and PA3, output ports PCϕ, PC1' and PC2', and output ports PEϕ, PE1 and PE2. In this circuit diagram of FIG. 5, the microswitches SW1 to SW4 of one group associated with the upper supply unit 51 are respectively designated by SWA1, SWA2, SWA3 and SWA4 while the microswitches SW1 to SW4 of another group associated with the lower supply unit 52 are respectively designated by SWB1, SWB2, SWB3 and SWB4.

The microswitches SWA1 to SWA4 have respective movable contacts electrically connected in common to the output port PCϕof the interface I/o and respective fixed contacts to the input ports PAϕ, PA1, PA2 and PA3 of the interface, whereas the microswitches SWB1 to SWB4 have respective movable contacts electrically connected in common to the output port PC1' of the interface and respective fixed contacts electrically connected to the input ports PAϕ, PA1, PA2 and PA3 of the interface. These microswitches SWA1 to SWA4 or SWB1 to SWB4 of each group are so electrically connected to the interface I/o that, depending on the number of the microswitches being closed upon insertion of the cassette C1 or C2 into the copying machine, an electrical intelligence signal indicative of the size of the copying papers contained in the cassette C1 or C2 can be fed to the interface I/o. More specifically, from the output port PCϕ, an electric signal for the detection of the size of the copying papers in the cassette mounted on the upper supply unit 51 is issued and fed, depending on the number of the microswitches SWA1 to SWA4 closed by the fingers 61 of the code member 60 in the cassette inserted in the upper supply unit 51, to some or all of the input ports PAϕ, PA1, PA2 and PA3 whereas, from the output port PC1', an electric signal for the detection of the size of the copying papers in the cassette mounted on the lower supply unit 52 is issued and fed, depending upon the number of the microswitches SWB1 to SWB4 closed by the fingers 61 of the code member 60 in the cassette inserted in the lower supply unit 52, to some or all of the input ports PAϕ, PA1, PA2 and PA3. It is to be noted that the time at which the electrical signal is generated from the output port PCϕis so designed as to be different from the time at which the electrical signal is generated from the output port PC1' whereby, even though the input ports PAϕ, PA1, PA2 and PA3 can receive both the electrical signal from the output port PCϕ and that from the output port PC1', not simultaneously, but at different timing, the detection of the size of the copying papers in the cassette C1 in the upper supply unit 51 can be carried out independently of the detection of the size of the copying papers in the cassette C2 in the lower supply unit 52.

The output port PC2' is adapted to generate therefrom an electric signal utilizable for the detection of the emptiness in the cassette in any one of the upper and lower supply units 51 and 52 and is electrically connected on one hand to the input port PA2 through the emitter-collector path of a transistor TR1 and on the other hand to the input port PA3 through the emitter-collector path of a transistor TR2. The base of each of the transistors TR1 and TR2 is adapted to receive an electric signal indicative of the emptiness of the cassette in the corresponding supply unit 51 or 52 as will be described in details later.

The output ports PEϕ and PE1 of the interface I/o are used to issue therefrom actuating signals necessary to activate clutches CL1 and CL2, respectively, which are so operatively associated with the feed rolls R1 and R2 as to drive the latter when activated. These clutches CL1 and CL2 are electrically connected to the respective output ports PEϕ and PE1 through switching circuits S1 and S2 of the same construction. The output port PE2 is electrically connected to an empty indicator lamp EL through a similar switching circuit S3 which may be of the same construction as the switching circuit S1. The clutches CL1 and CL2 and the empty indicator lamp EL are in turn connected to a source Vcc of electric power and are adapted to be activated by the output signals generated one at a time respectively from the output ports PEϕ, PE1 and PE2.

Also electrically connected to the power source Vcc are empty detecting circuits 80 and 81 respectively including the detector cells PC1 and PC2, empty detecting circuits 80 and 81 having their outputs electrically connected respectively to the bases of the transistors TR1 and TR2. It is to be noted that, since the empty detecting circuits 80 and 81 are of the same construction, reference will now be made only to the empty detecting circuit 80 for the sake of brevity.

The detector cell PC1 is employed in the form of a photoelectric transducer of a type, the resistance of which varies in response to the intensity of light falling thereon, and constitutes a bridge circuit together with resistors r1, r2 and r3. This bridge circuit has its outputs electrically connected to inputs of a comparator 82, an output of comparator 82 being connected to the base of the transistor TR1 through series connected resistor r5 and diode D. The resistors r1 to r3 forming the bridge circuit together with the detector cell PC1 have their resistances so selected that, when no light emitted by the light source 64 (FIG. 4) falls on the detector cell, the bridge circuit is held in an equilibrium state, but when the light from the light source 64 falls on the detector cell due to the absence of any copying paper in the corresponding cassette and the resistance of the detector cell falls accordingly, the comparator 82 can generate the output signal which is applied to the base of the transistor TR1 to trigger the latter on thereby allowing the output signal from the output port PC2, when so generated, to be fed to the input port PA2 through the transistor TR1 to effect the detection of the emptiness of the cassette.

Both the size indicating signal indicative of the size of the copying papers in each of the cassettes and the empty indicating signal indicative of the emptiness of any one of the cassettes are fed through the interface I/o to the random access memory RAM of the micro-computer MC and, depending upon the contents thereof, the actuating signals for activating the clutches CL1 and CL2 and the empty indicator lamp EL, respectively, can be generated one at a time according to the program stored in the read only memory ROM.

In the foregoing description, the paper feeder constructed according to the present invention has been described as having the upper and lower supply units 51 and 52. However, it is to be noted that the present invention can equally be applicable to the paper feeder having three or more supply units, in which case a flow chart, that is, the program set in the micro-computer, must be different from that hereinbefore described. However, even the paper feeder of the type having three or more supply units can operate in a manner similar to that described for the purpose of the present invention though a coding system, wherein a particular code is employed for a given size of copying paper, is required in place of the discriminating flag UP with the increased number of steps of comparison of the size of copying papers in one cassette with that in any one of the other cassettes.

So far as the paper size detection is involved, instead of the employment of the code members 60 in combination with the microswitches SW1 to SW4, any coding indicia, for example, black-and-white markings, may be employed in combination with photoelectric reader elements. Alternatively, a combination of magnets with reed switches may also be employed. Yet, where the present invention is applied to a paper feeder of a type supplying recording materials each in the form of a rolled paper, means for detecting the width of a web of paper from the paper roll in terms of the position of a microswitch adapted to be actuated by the web of paper being transported may be used.

So far as the emptiness detection is involved, instead of the employment of the lamp 64, the detector cells PC1 and PC2 and the apertures 62, means including microswitches or reed switches may be employed, in which case each of the microswitches or reed switches is to be positioned adjacent the exit opening of the corresponding cassette.

With respect to the micro-computer, the use of the micro-computer is advantageous in that such complicated controls as size discrimination, empty detection and size comparison can readily be achieved without rendering the copying machine to be bulky in size and without rendering the requisite circuit construction to be complicated. So far this can be achieved, any known micro-computer, for example, of a type generally used in controlling the sequence of any other machine or machines may be employed in the present invention.

Although the present invention has fully been described by way of example, it is to be noted that changes and modifications, which are obvious to those skilled in the art, are to be construed as included within the true scope of the present invention unless they depart therefrom.

We claim:

1. In a machine comprising at least first and second supply units for accommodating respective recording materials; first and second paper feeders for successively supplying the recording materials respectively from said first and second supply units; selecting means for causing either one of said first and second paper feeders to supply the recordingmaterials successively from the corresponding supply unit; first detecting means for detecting the size of the recording materials contained in each of said first and second supply units; second detecting means for detecting the presence or absence of the recording materials in each of said first and second supply units; and a control device provided for controlling the operation of at least said first and second paper feeders, the improvement wherein said control device comprises:

first discriminating means for discriminating the presence or absence of the recording materials in the selected one supply unit on the basis of a signal fed from said second detecting means;

second discriminating means for discriminating the presence or absence of the recording materials in the other supply unit, said second discriminating means being operable when said first discriminating means discriminates that said one supply unit has become empty;

comparing means, operable when said second discriminating means discriminates that said other supply unit is loaded with the recording material, for comparing, on the basis of a size signal fed from said first detecting means the size of the recording material in said one supply unit with the size of the recording materials in said other supply unit; and means, operable only when the sizes of the respective recording materials in said one and said other supply units have been determined to be identical with each other by said comparing means, for generating a command signal for causing the respective paper feeder to supply the recording materials from said other supply unit, such that the recording materials are fed from said other supply unit until said other supply unit is empty.

2. The improvement claimed in claim 1, wherein said control device comprises a computer operable to control the operation of the machine, said computer including means for receiving signals from said second detecting means and said first detecting means, said computer storing a program necessary to control the sequence of operation of said first and second discriminating means, said comparing means and said command signal generating means.

3. The improvement claimed in claims 1 or 2, wherein said first detecting means comprises, for each said supply unit, a respective code member having thereon a plurality of members having a location and configuration representative of the size of the respective recording material, and a plurality of switches adapted to be contacted by said plurality of members for generating said size signal.

4. The improvement claimed in claims 1 or 2, wherein said second detecting means comprises at least one light source, and at least first and second detector cells positioned with respect to said light source to detect the presence or absence of said recording materials in said first and second supply units, respectively.

* * * * *